US005239797A

United States Patent [19]

Oldendorf

[11] Patent Number: 5,239,797

[45] Date of Patent: Aug. 31, 1993

[54] PROTECTIVE BRIDGE FOR WINDOW SILLS

[76] Inventor: Günter Oldendorf, Buchfeldstrasse 41, W-7085 Bopfingen, Fed. Rep. of Germany

[21] Appl. No.: 720,497

[22] PCT Filed: May 8, 1990

[86] PCT No.: PCT/EP90/00739

§ 371 Date: Jul. 22, 1991

§ 102(e) Date: Jul. 22, 1991

[87] PCT Pub. No.: WO90/13724

PCT Pub. Date: Nov. 15, 1990

[30] Foreign Application Priority Data

May 10, 1989 [DE] Fed. Rep. of Germany ..... 3915265

[51] Int. Cl.[5] ..... E04B 1/70

[52] U.S. Cl. ..... 22/216; 52/210; 52/213; 52/215; 52/204.55

[58] Field of Search ..... 52/211-216, 52/364, 40, 204.55

[56] References Cited

U.S. PATENT DOCUMENTS

| | | | |
|---|---|---|---|
| 1,361,586 | 12/1920 | Johnson | 52/216 X |
| 1,473,584 | 11/1923 | Norman | 52/216 |
| 1,498,244 | 6/1924 | Lee | 52/216 X |
| 1,720,200 | 7/1929 | Baum | 52/364 X |
| 1,723,991 | 8/1929 | Baum | 52/216 X |
| 1,772,657 | 8/1980 | Baum | 52/216 X |
| 1,785,174 | 12/1980 | Baum | 52/216 |
| 1,788,143 | 1/1981 | Baum | 52/216 X |
| 1,792,725 | 2/1981 | Baum | 52/216 X |

FOREIGN PATENT DOCUMENTS 1946206 9/1969 Fed. Rep. of Germany .

*Primary Examiner*—Richard E. Chilcot, Jr.
*Attorney, Agent, or Firm*—Kane, Dalsimer, Sullivan, Kurucz, Levy, Eisele and Richard

[57] ABSTRACT

The reinforcing bridge is intended to prevent crumbling of plaster at the lateral ledges of window sills under the influence of vibrations, wind and thermal expansions. The reinforcing bridge has a piece of elastic, plastic profile, which serves to embrace one of the lateral cover strips (30.2) of the window sill (30). After the reinforcing bridge (1) is mounted on the cover strip (30.2) of the window sill (30), reinforcing pins (40, 42) are seated in the profile and protrude into the space, which is to be occupied by the plaster (26, 28) of the window jamb and the facade. First, the window sill (30) with its cover strips (30.2) is mounted, a reinforcing bridge (1) is then attached on both sides of the cover strips (30.2) and finally the plaster (26, 28) is applied on the window jamb and the facade.

6 Claims, 2 Drawing Sheets

Figure 4:
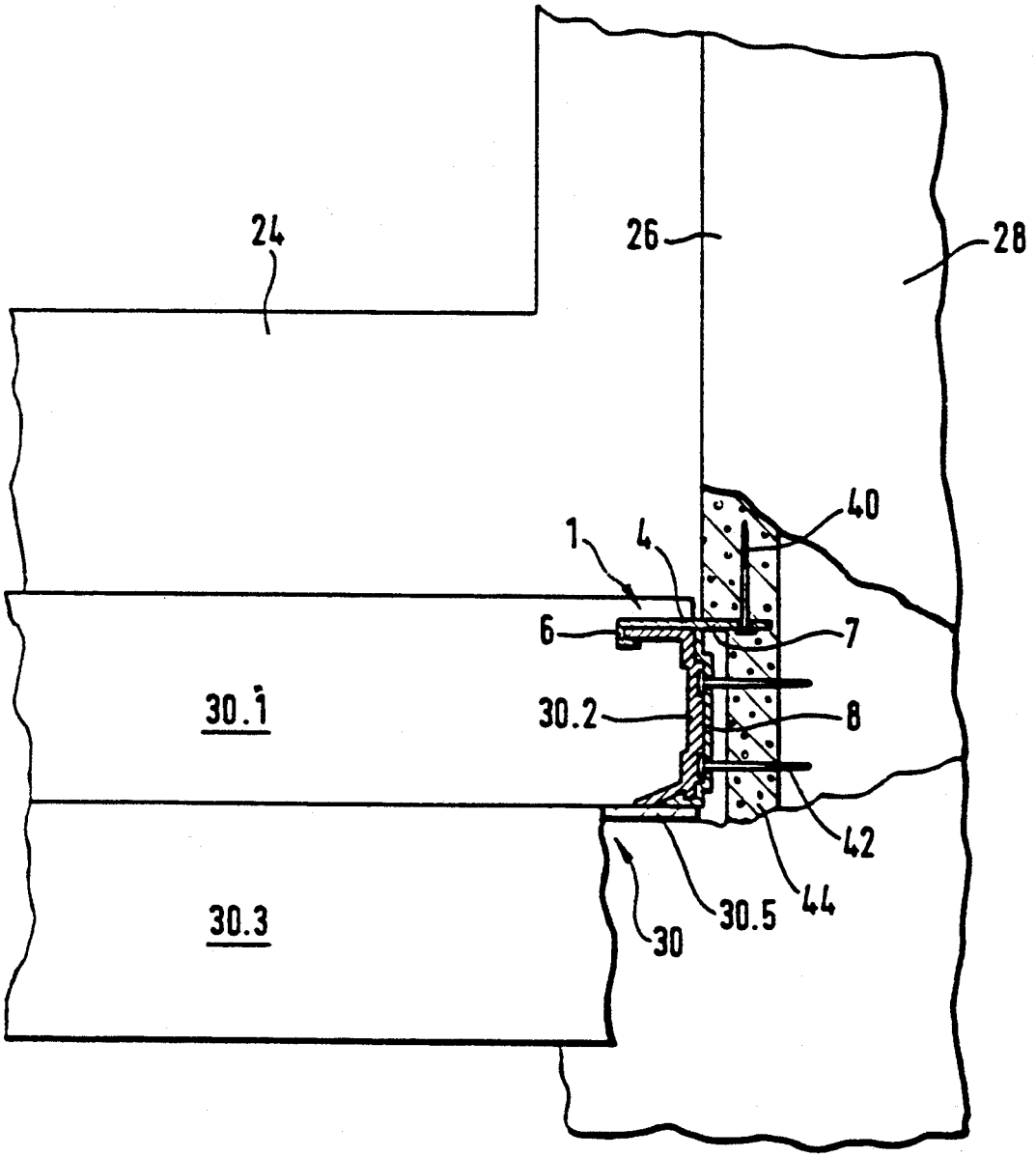

Fig. 1
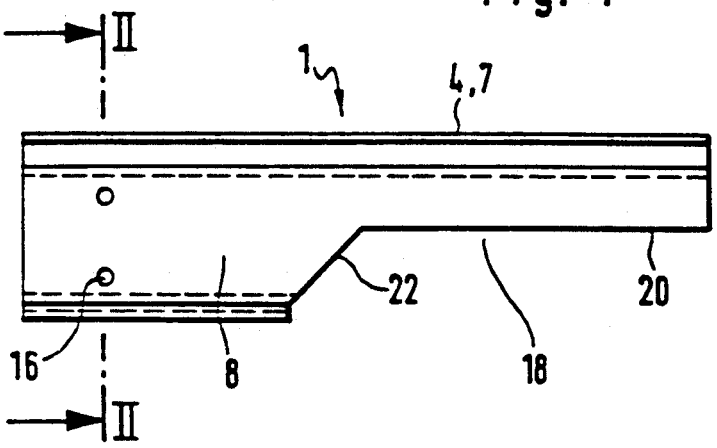
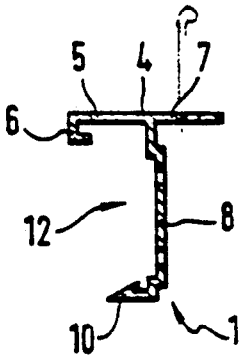
Fig. 2
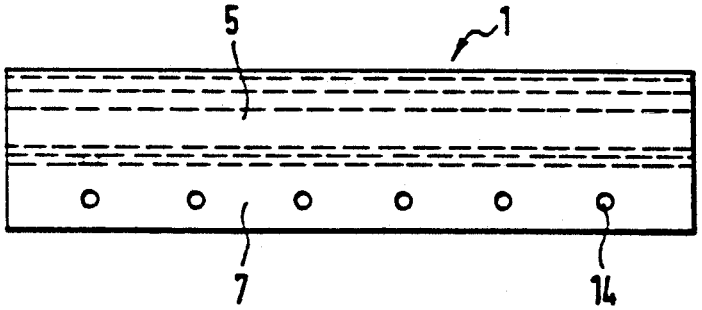
Fig. 3

PROTECTIVE BRIDGE FOR WINDOW SILLS

The invention relates to a protective bridge for the lateral end portions of window sills.

At their left and right edges, window sills usually have upright, lateral end portions. The plaster of the window soffitt normally extends as far as this end portion. Under the influence of vibrations, such as from construction work, street traffic or wind, thermal expansions and the expansion and contraction of the wood of the window frame, cracks arise in the plaster. After some time, the plaster crumbles above and outside of the end portions.

This crumbling is to be prevented by the present invention.

This objective is accomplished by the invention in accordance with following description.

After the installation of the window sill with its two end portions, a protective bridge, which embraces this end portion elastically like a clamp, is mounted on the outside of each end portion. In the protective bridge, fastening pins are provided, which are a type of nail with transverse ribs and protrude upwards and outwards after the installation. The plaster of the window soffitt and of the facade is then applied, the fastening pins also being enclosed. The protective bridge is then firmly seated in the plaster, but remains movable in its longitudinal direction, that is, at right angles to the plane of the window frame. Owing to the fact that the protective bridge embraces the end portion elastically, a certain movement at right angles to the end portion, upwards, downwards and also sideways is possible. In the event of vibrations, thermal expansions, etc., the protective bride can thus move relative to the end portion that is embraced by it, so that the plaster is spared and does not develop any cracks or crumble away.

FURTHER DEVELOPMENTS OF THE INVENTION

In cross section, the protective bridge can have the basic shape of a T. The vertical leg and the leg of the T pointing against the window sill together can form an elastic clamp for embracing the lateral end portion. Relative motions between the protective bridge and the lateral end portion are made possible in this manner.

Preferably, the fastening pins can be mounted in an upright position in an upper leg of the T-shaped profile, which later on protrudes into the plaster of the window soffitt and the facade, and, moreover, in a longitudinal row of the profile, while fastening pins, which protrude only from the external end of the vertical leg in a horizontal direction into the space that is to be occupied by the facade plaster, can be provided at the vertical leg.

So that the protective bridge can be introduced more readily after the window sill and the lateral end portions are installed, the vertical leg can have a cutout into its back region. A sloping edge of this cut out can start at the lower edge of the leg and extend upwards at the rear and go over into an edge, which extends in the longitudinal direction of the profile.

Embodiments with further characteristics of the invention are described in the following by means of the drawings, in which FIG. 1 shows a side view of a protective bridge, for the, as seen from the outside, right end of the window sill, FIG. 2 shows a cross section in the II—II plane of FIG. 1, FIG. 3 shows a plan view of the protective bridge of FIGS. 1 and 2 and FIG. 4 shows the, as seen from the outside, right lower corner of a window frame with the adjacent parts of the wall of the house, viewed, however, in the direction of the somewhat downwards sloping window sill, which is shown partially in plan view and partially in section.

As shown by FIGS. 1 to 3, the protective bridge consists of a piece of elastic plastic with a T-shaped profile. The protective bridge is shown in its use position, in the manner in which it embraces the, as viewed from the outside, right lateral end portion 30.2 of a window sill 30. The cross sectional shape of the end portion 30.2 is shown in FIG. 4, as seen from the outside. Basically, it is U-shaped. On the whole, the protective bridge 1 has a T-shaped cross section. The protective bridge has a, here as in the following always related to the installed position, horizontal leg 4, which is flat and form at its left edge a U-shaped claw 6. The protective bridge furthermore has a vertical leg 8, the main section of which is offset somewhat to the right, by about the thickness of the material of the protective bridge. At its lower edge, the vertical leg has an end section 10, which, protruding to the left and fitting the cross sectional shape of the lateral end portion 30.2, also is constructed in the shape of a claw and runs out to a pointed edge.

The first section 5 with its U-shaped claw and the end section 10, together with the vertical leg 8, form a clamp 12, which serves to embrace the lateral end portion 30.2 elastically.

In its longitudinal direction, the second section 7 has a row of holes 14, which serve to accommodate the fastening pins 40. Two holes 16, one of which is above the other, are provided for the same purpose near the left edge of the vertical leg 8.

In its backwards, lower half, the protective bridge 1 has a cutout 18 (FIG. 1), which is edged by an edge 20, which is parallel to its longitudinal direction, and by a sloping edge 22.

FIG. 4 shows the, viewed from the outside, right lower corner of a window frame 24 and, next to it on the right, the plaster 26 of the window soffitt, which goes over into the plaster 28 of the facade. At the lower end of the window frame 24, there is the window sill 30, from which the rear section 30.1, which is bent upwards and fastened to the window sill, as well as the outer section 30.3, which in the drawing is the front section that protrudes downwards, can be recognized. The viewing direction is in the main plane of the window sill, so that nothing can be recognized of its main part 30.5, with the exception of a portion at the right, which is shown in section. The right lateral end portion 30.2 of the window sill 30, which is constructed as an approximately U-shaped profile, can be recognized.

Furthermore, the protective bridge 1, the details of which are shown in FIG. 2, can be recognized. It embraces the lateral end portion 30.2 in clamp-like fashion. A row of fastening pins 40 is inserted through the second (right) section 7 of the protective bridge and, moreover, in such a manner, that the pins project upwards. Two fastening pins 42, one above the other, which protrude to the right, are inserted through the holes 16 of the front section of the reinforcing bridge (compare FIG. 1).

During the installation, the window frame 24 is installed first in the well-known manner. The window sill 30 is attached with its rearwards section 30.1 to the window frame 24 in a manner that is not shown, for example, with bolts. Before the plaster is applied, the protective bridge, which is provided with fastening pins 40 and 42, is then pushed between the wall or its thermal insulation 44 on the one hand and the lateral end portion 30.2 of the window sill on the other in the direction of this lateral end portion and finally snapped elastically over it. The fastening pins 40 now point upwards in an initially free space and, moreover, over the whole depth of the window sill, while the fastening pins 42 protrude only forwards, that is, at the outside into a space, which is to accommodate plaster from the window soffitt and the facade. Finally, the plaster is applied, the protective bridge being held fast by its pins. The second, that is external section 7 of the protective bridge is also plastered.

REFERENCE SYMBOLS

1—reinforcing bridge
4—horizontal leg
5—first section
6—U-shaped claw
7—second section
8—perpendicular leg
10—end section
12—clamp
14—hole
16—hole
18—cutout
20—edge
22—sloping edge
24—window frame
26—plaster of the window jamb
28—facade plaster
30—window sill
30.1—rearward section
30.2—cover strip
30.3—outer section
30.5—main part
40—reinforcing pin
42—reinforcing pin
44—thermal insulation

I claim:

1. A protective bridge for a window sill having lateral end portions 30.2 and securing elastically the lateral end portions 30.2 of the window sill into a window opening, said bridge comprising:

a plastic member embracing one of said lateral end portions;

spaces formed between the sill and the window opening;

fastening means extending into spaces formed between the sill and the window opening for fastening said bridge when said spaces are filled with plaster;

said plastic member being arranged and constructed to absorb elastically motions of said window sill thereby preventing cracking of said plaster.

2. The protective bridge of claim 1 wherein said plastic member has a T-shaped profile defined by a vertical leg and a horizontal leg with a first horizontal and a second horizontal section, said vertical leg and said first horizontal section forming an elastic clamp for embracing said one lateral end portion, with said second horizontal section protruding into said spaces.

3. The protective bridge of claim 2 wherein said fastening means include first fastening pins inserted into and extending upwardly from said second horizontal section into said spaces.

4. The protective bridge of claim 2 wherein said fastening means includes second fastening pins inserted into and extending horizontally from said vertical leg into said spaces.

5. The protective bridge of claim 2 wherein said vertical leg is formed with a rearward lower region having a cutout of about half the height and length of said vertical leg.

6. The protective bridge of claim 5 wherein said cutout has a sloping edge starting from a lower edge of said vertical leg, and a straight edge parallel to said lower edge.

* * * * *